United States Patent [19]

Cutmore

[11] Patent Number: 4,924,688

[45] Date of Patent: May 15, 1990

[54] MILL ROLL

[75] Inventor: John P. Cutmore, Townsville, Australia

[73] Assignee: Copper Refineries Pty. Limited, Australia

[21] Appl. No.: 83,241

[22] Filed: Aug. 10, 1987

[30] Foreign Application Priority Data

Aug. 11, 1986 [AU] Australia ..... PH7376

[51] Int. Cl.[5] ..... B21B 27/02

[52] U.S. Cl. ..... 72/199; 29/125; 29/130; 29/132

[58] Field of Search ..... 72/199, 365, 366; 29/130, 132, 125

[56] References Cited

U.S. PATENT DOCUMENTS

| | | | |
|---|---|---|---|
| 3,535,904 | 10/1970 | Bindernagel | 72/199 |
| 3,577,619 | 5/1971 | Strandel | 29/132 X |
| 3,787,942 | 1/1974 | Bindernagel et al. | 29/125 |
| 4,056,873 | 11/1977 | Cassard et al. | 29/132 |
| 4,105,264 | 8/1978 | Zimmermann et al. . | |
| 4,115,910 | 9/1978 | Hertel et al. | 29/125 X |
| 4,777,822 | 10/1978 | Uemura et al. | 72/366 |
| 4,817,410 | 4/1989 | Yatsuzuka et al. | 72/199 |

FOREIGN PATENT DOCUMENTS

| | | | |
|---|---|---|---|
| 2536354 | 3/1976 | Fed. Rep. of Germany | 29/132 |
| 3428731 | 2/1986 | Fed. Rep. of Germany . | |
| 59-21414 | 2/1984 | Japan . | |
| 1252549 | 11/1971 | United Kingdom | 29/125 |

*Primary Examiner*—Robert L. Spruill

*Attorney, Agent, or Firm*—Stevens, Davis, Miller & Mosher

[57] ABSTRACT

A mill roll with a ceramic working surface comprises an annular ceramic formation sleeved upon a hub. In preferred embodiments the ceramic formation is clamped to the hub at angled edge walls so that the formation is held under compression.

3 Claims, 2 Drawing Sheets

MILL ROLL

FIELD OF THE INVENTION

This invention relates to improved means for rolling of bars or rods of various cross-sectional shapes from metals and alloys and more particularly to rolling of copper metal intended for wire production.

BACKGROUND OF THE INVENTION

In rolling of metal or alloy rods, metal stock is passed progressively through a series of rolls which encourage the plastic flow of metal causing length extension and transverse area reduction of the stock.

The mill rolls are subjected in use to arduous conditions of heat, pressure, and friction.

In copper rolling to produce stock for wire production the mill rolls are cylindrical typically having a diameter of about 220 mm and a width of 100 mm, that is to say, a width much greater than the rolled stock. As one part of the roll circumference becomes excessively worn, another part is brought into use.

When as a result of wear, no further part of the roll surface is satisfactory, the roll surface is machined.

The costs of roll installation, roll refurbishing, and mill down time neccessitated by the wear of mill rolls, together with costs of the inventory of mill rolls required, are substantial.

Hitherto, mill rolls have been manufactured from tool steel. Steel is readily machinable before and after wear. It has a sufficient coefficient of friction to roll copper without undue slippage. It is able to withstand thermal and mechanical shock and it is sufficiently robust and resistant to fracture for use in a mill environment.

Ceramics such as zirconia, silicon nitride, silicon carbide, alumina and others are known to have high strength and wear resistance and for these reasons have been used as hot metal extrusion dies. To date no such materials have been successfully used for mill rolls because the difficulty and cost of fabricating a conventional mill roll wholly from ceramics renders the use of ceramics uneconomical for the purpose and also because ceramics are relatively susceptible to fracture and thermal shock under conditions to which mill rolls are subjected. More particularly it has not hitherto been thought practicable to manufacture an object of the size, mass and precision of a mill roll for copper rolling from ceramics.

An object of the present invention is to provide an improved mill roll.

A further object is to provide a mill roll having a ceramic working surface and which is of acceptability low cost and/or high durability.

According to one aspect the present invention consists in a mill roll comprising a hub and a ceramic annular formulation sleeved upon the hub to provide a mill roll working surface.

In preferred embodiments the ceramic annular formation has side walls extending at an angle to the hub radial direction and is clamped to the hub by clamping means engaging the side walls and maintaining the formation under compression.

An embodiment of the invention will now be described by way of example only with reference to the accompanying drawings wherein

DESCRIPTION OF PREFERRED EMBODIMENTS

Figure 1:
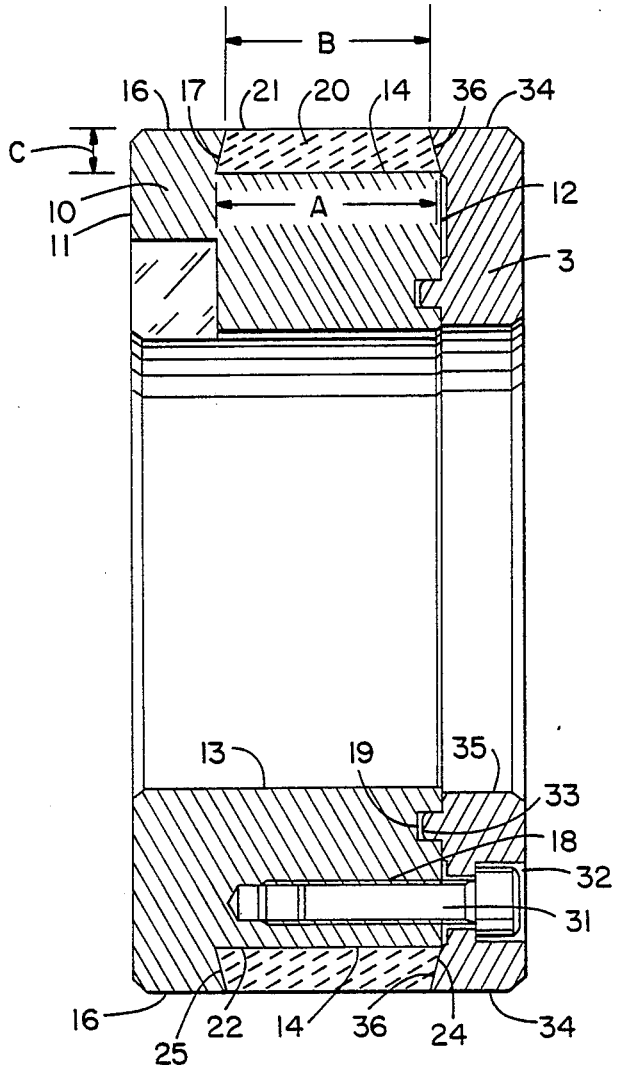
FIG. 1 shows a mill roll according to the invention in diametric cross-section.
Figure 2:
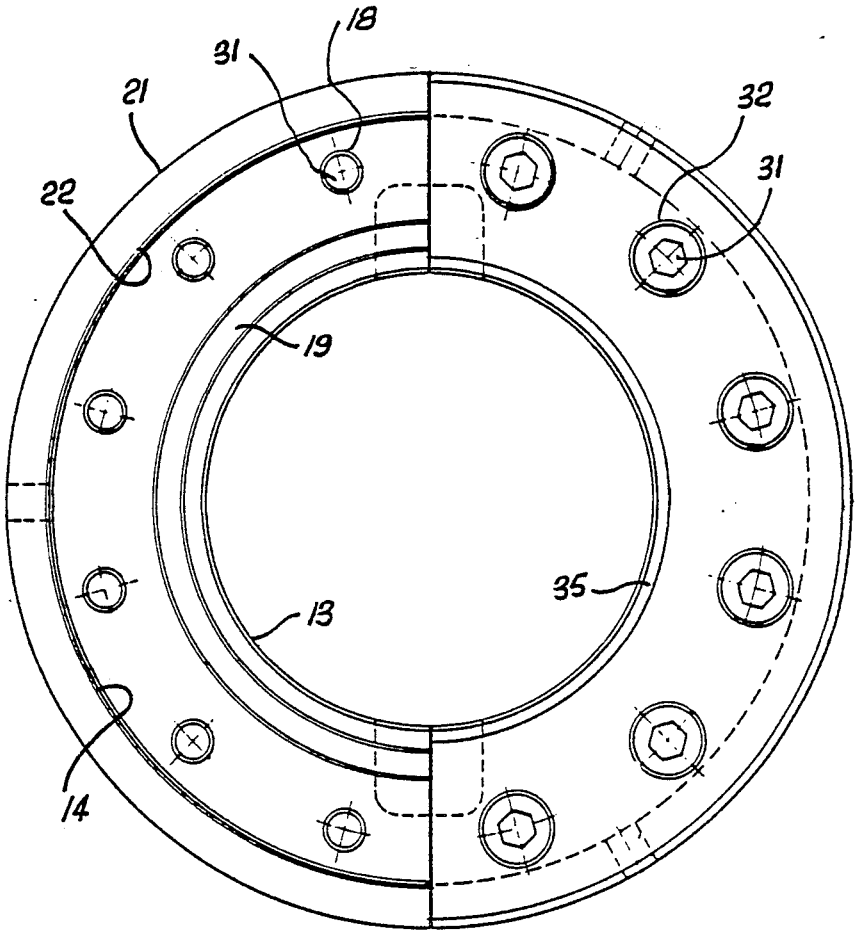
FIG. 2 shows parts of the mill roll shown in FIG. 1 in end elevation, half in section.

With reference to FIGS. 1 and 2 there is shown a mill roll for use in rolling copper.

Hub 10 has sides 11 and 12 and an axially extending bearing surface 13 whereby hub 10 may be mounted for rotation on an axle (not shown).

Hub 10 has a peripheral cylindrical surface 14 on which a tire 20 may be sleeved. Tire 20 is an annular ceramic formation, and in the present embodiment is formed from silicon nitride.

Peripheral cylindrical surface 14 of hub 10 is stepped radially outwards near side 11 to provide a tire retaining collar having a peripheral collar surface 16 and an undercut escarpment 17.

Tire 20 is of toroidal shape having a radially outer working surface 21, a radially inner surface 22, the radially inner surface 22 extending in the axial direction beyond each end of the working surface 21 and having edge walls 24, 25 extending from working surface 21 to inner surface 22 and tapered at an angle to the radial direction.

In section as viewed in FIG. 1 in the diametric plane tire 20 is of trapezoidal shape. It has an outside diameter about 220 mm and a thickness of 10 mm in the radial direction. Edge wall 25 of tire 20 is tapered at an angle to the radial direction which corresponds with the angle of undercut escarpment 17 of the hub retaining collar so that tire wall 25 abuts the escarpment 17.

As is shown in FIG. 1, the width dimension "A" in the axial direction of inner cylindrical surface 22 of tire 20 is greater than the axial width dimension "B" of the outer cylindrical working surface 21.

The axial width dimension "B" of the outer cylindrical working surface 21 is much greater than the thickness "C" of the ceramic in the radial direction.

Tire 20 is clamped in abutting engagement with escarpment 17 by retaining rim 3 which is mounted to side 12 of hub 10 by a plurality of threaded studs 31 passing through stud appertures 32 of rim 3 and into threaded stud bores 18 of hub 10. Formations 33 of rotary rim 3 engage with grooves 19 of the hub. Rim 3 has an outer peripheral surface 34, an inner surface 35 of slightly greater radius than bearing surface 13 of the roller and a clamping wall 36 at an angle to the radial direction corresponding to the angle of wall 24 of the tire to the radial direction.

When rim 3 is tightened against hub 10 toroidal tire 20 is clamped in abutment with angled surfaces 17 and 36 under compression and with a component of force pressing the radially inner tire surface 22 against peripheral cylindrical surface 11 of hub 10.

Hub 10 and rim 3 are made from tool steel in the presently described example.

Tire 20 is a ceramic, moulded, fired formation for example of silicon nitride and is machined to required tolerance.

The shape of the part facilitates manufacture of tire 20 with a minimum requirement for machining.

For preferance all the surfaces of the rolling mill with which the stock comes in contact are also formed from ceramic, including the cooling and waxing tube, feed cones and entry guide rolls of the rolling mills.

The useful life of the parts has been found to be much longer than that of steel parts and suitable ceramics are able to withstand the thermal shocks of coolant and pickle solutions at a work temperature of around 650° C.–850°. It has been found that copper milled substantially without working contact with steel, when drawn into fine wire, has significantly fewer breaks per kilo than wire drawn from copper hot rolled by means of a conventional tool steel mill.

As will be apparent to those skilled in the art from the above description, the invention may be embodied in other forms without departing from the concept herein taught, and such embodiments are deemed to be within the scope hereof.

I claim:

1. A mill roll for use in rolling copper intended for the production of copper wire consisting of:

a hub having a cylindrical peripheral surface on which is sleeved a ceramic annular formation to provide a mill roll working surface;

said ceramic formation having a radially inner surface, a radially outer working surface and angled side edges defining a trapezoidal cross-section, the axial width dimension of the inner surface being greater than the axial width dimension of the outer surface and the axial width dimension of the outer surface being much greater than the radial thickness dimension, and clamping means engaging the angled side edges of the ceramic formation and maintaining the ceramic formation under compression with a component of force pressing the inner surface of the formation against the hub peripheral surface sufficiently to take up roll forces and torque, a retaining rim mounted to one axial side of the hub by a plurality of axially extending threaded studs passing through a like plurality of stud apertures in said retaining rim and threaded into said hub;

said retaining rim having a tapered face on its axially inner surface, said face lying at an angle to correspond with the angled side edge of said ceramic annular formation.

2. A mill roll according to claim 1 wherein the ceramic is silicon nitride.

3. The mill roll of claim 1 in which said retaining rim comprises a one piece ring bearing directly on one of the angled side edges of the ceramic formation.

* * * * *